United States Patent [19]

Agnello

[11] Patent Number: 4,916,679

[45] Date of Patent: Apr. 10, 1990

[54] SPORTS WATCH PROTECTOR

[76] Inventor: Mark S. Agnello, 510 Playa Blvd., La Selva Beach, Calif. 95076

[21] Appl. No.: 257,394

[22] Filed: Oct. 13, 1988

[51] Int. Cl.[4] ..... G04B 37/00

[52] U.S. Cl. ..... 368/283; 368/286

[58] Field of Search ..... 368/88, 276, 278, 279, 368/281–282, 286, 291

[56] References Cited

U.S. PATENT DOCUMENTS

| | | | |
|---|---|---|---|
| 1,857,195 | 5/1932 | Karpf | 368/281 |
| 2,076,221 | 4/1937 | Bradbury | 368/281 |
| 2,227,131 | 12/1940 | Friedman | 368/281 |
| 2,249,550 | 7/1941 | Williams | 368/281 |
| 2,344,136 | 3/1944 | Dressen | 368/282 |
| 2,584,270 | 2/1952 | Hucknall | 368/281 |
| 4,277,842 | 7/1981 | Richards | 368/282 |

*Primary Examiner*—Vit W. Miska

*Attorney, Agent, or Firm*—The Dulin Law Firm

[57] ABSTRACT

A sports wrist watch protector comprising a continuous band portion, dependent side portions and a central aperture transverse to the length of the band through which the watch crystal and encircling bezel may be accessed. The band portion comprises an elastomeric fabric of laminate material for universal sizing. The elastomeric fabric of nylon, lycra, terry, plush or velcro laminated on one or both sides to a neoprene core, having differential stretch, with stretch along one axis greater than the perpendicular axis. The length of the band (circumference) is oriented along the greatest stretch axis so that upon stretching the depending side edges curl around the watch band. The central aperture is perpendicular to the band axis (circumference) and is either oval or rectangular in shape in the relaxed position, so that it stretches in the operative position to a round or square shape to conform with the shape of the wearer's watch. In its operative position, the protector prevents the wrist watch from falling off the wearer's wrist during rough water, or road sports or other activities during which the buckle, fastener or pins of a wrist watch may come apart. Opposite fabric faces may be different colors, and at least one is a "neon" color or reflective for safety. A microwave transponder may be included in the band for location of the wearer when lost.

15 Claims, 1 Drawing Sheet

SPORTS WATCH PROTECTOR

SPECIFICATION

Field:

This invention relates to improved sports wrist watch protectors for use while participating in highly active sports, such as rough water sports, off-road, skiing, rock or mountain climbing sports or other activities in which the pins of a wrist watch may fall out. In particular, the sports wrist watch protector of this invention completely covers the watch band, with a central aperture through which the watch crystal, and optionally the encircling bezel, protrudes. The protector is characterized by an elastic band which fits the circumference of the wearer's wrist, holding the watch and watch band securely against the wearer's wrist, thus preventing loss of the watch should the fastener or pins become dislodged.

BACKGROUND AND INFORMATION DISCLOSURE STATEMENT

Athletes who participate in rough water sports, such as ocean swimming, surfing, wind-surfing, scuba diving or triathlons, or rough road sports such as moto-cross and mountain bike riding often wear special watches designed with features important to the sport. For example, scuba divers need to set their watches to keep track of the time spent at different depths. These watches are designed for user interaction during the sports activity. Jarring caused by rough waters, or rough roads, the salt content of the ocean and the design of most watches, often cause the pins in the sports watches to wear out, break or work lose. The watch is subsequently lost when it falls off the wrist of the wearer. Such specialty watches are relatively expensive.

The prior art teaches the use of a transparent protective shell integrally attached to a wrist band as in U.S. Pat. Nos. 4,277,842 (Richards, 1981) and 2,584,270 (Hucknall, 1948). The shell is positioned over the crystal of the wearer's watch to protect it from water and dirt. The band is either adjustable, as in Richards, or an endless wide elastic strip, as in Hucknall. The shell encasing the watch crystal makes it impossible for the wearer to make any adjustments to the watch while the protective cover is in place.

Unlike watches worn as jewelry or ornamentation, sports watches of the type for which this invention is used are dynamic pieces of equipment. They may have a dial used for setting times, depths, distances or any other standard measurement. Modern sports watches often have buttons and knobs for activating a stopwatch device, for setting and stopping an alarm or for clocking times and distances. It is essential to the function of the watch that the wearer have access to the watch crystal at all times The present invention leaves the watch crystal accessible to the wearer by having a central opening through which the watch crystal and encircling bezel passes.

The prior art also teaches encasing the watch in a transparent casing, as in U.S. Pat. Nos. 2,076,221 (Bradbury, 1937) and 2,227,131 (Friedman, 1940). Bradbury discloses use of a transparent tube which encircles the wrist of the wearer, and which is folded over to completely encapsulate the watch. It is difficult to get on, since the watch must be folded into the band, then the entire device slipped onto the wearer's wrist. Friedman discloses a water- and sandproof encasement for the watch with an adjustable strap and buckle. Exposed to salt water and other rough elements, the buckle may fall off, and the wearer may lose the watch. As with the Richards and Hucknall patents, both Bradbury and Friedman restrict access to the watch crystal. Most sports watches today are designed to allow the user to adjust dials located on the watch. By encapsulating the watch, the wearer is prevented from using the protected watch, thus defeating the purpose of owning a sports watch.

U.S. Pat. Nos. 1,857,195 (Karpf, 1932) and 2,249,550 (Williams, 1941) disclose placing a strip of transparent material over the wrist and watch of the wearer to protect and guard the watch. Karpf and Williams use continuous transparent tubing which stretches around the wearer's wrist, completely covering the watch and restricting access to the watch bezel.

U.S. Pat. No. 2,344,136 (Dressen, 1944) discloses a wrist watch protector which is not transparent. It is specifically designed to cover the crystal of the watch, and was intended for use by soldiers. Dressen has a transversely split band with a clasp mechanism for adjustable fit. The edges of the band are tubing containing elastic band to assure a tight fit around the edges of the wrist watch band. The elastic in the outer edges permits the wearer to lift the edges of the watch to see what time it is. For athletes who require concentration and the use of both hands to participate, as in wind-surfing, such a wrist watch protector would not be useful.

There is thus a need for a sports wrist watch protector that prevents the watch from being dislodged from the wearer's wrist due to pins falling out, while at the same time allowing the wearer to access the watch crystal, encircling bezel and adjustment buttons and knobs thereon.

THE INVENTION

Ojects

It is among the objects of the invention to provide a sports wrist watch protector which will prevent the loss of the watch during active sports by covering the watch band and case thus not only reducing the opportunity for the watch band pins to work loose, but preventing the watch from falling off the wearer's wrist.

It is another object of the invention to provide a sports wrist watch protector with a central aperture through which the watch crystal and encircling bezel protrude, allowing the wearer to access the watch crystal and surrounding bezel.

It is another object of the invention to provide a sports wrist watch protector of an elastic material, preferably a neoprene material, which is water-proof and provides warmth and protection to the wearer against cold water, snow, sand and other elements which cause discomfort or damage to the watch or pins.

It is another object of the invention to provide a sports wrist watch protector of different colors which may be coordinated with the wearer's wet suit, swimsuit or other outer sportswear.

It is another object of the invention to provide a sports wrist watch protector of easy manufacture and of one size to fit all wearers and all watches such that the wearer can use the same protector for different watches.

Still further and other objects of the invention will be evident from the Summary, Drawings, and Detailed Description of Best Mode of the Invention, Abstract and Claims.

SUMMARY

Participants in active sports, for example, but not limited to, rough water sports such as ocean swimming, surfing, wind-surfing, scuba diving, or triathlons and rough road sports such as moto-cross and mountain bike riding, often wear special watches designed with features important to the sport. For example, scuba divers need to set their watches to keep track of the time spent at different depths. Rough waters, rough roads, the salt content of the ocean and the design of most watches, often cause the pins in the watches work loose and the watch to fall off the wearer's wrist. As these watches are expensive, currently ranging in price upwards from $150.00, the loss of such a watch is not only inconvenient, but costly. The sports wrist watch protector of the invention holds the watch to the wrist of the wearer in such a manner that if the case pins of the wrist watch or the buckle comes loose, the watch will not fall off the wearer's wrist.

The sports wrist watch protector of the invention comprises a continuous band of elastic fabric laminate material which encircles the wearer's wrist, with dependent side portions and a central aperture transverse to the length of the band through which the watch crystal, and optionally the encircling bezel, protrude. The protector completely covers the watch band, pressing it against the wearer's wrist, and preventing it from falling off the wearer's wrist even when the fastening device (buckle) or one or more of the case pins dislodge.

The protector, including the dependent side portions, encircles the wrist of the wearer, completely covering the band of the wearer's sports wrist watch. Around the central aperture, the protector widens to afford a margin, typically of at least ¼ inch, in the relaxed form, between the outer ends of the aperture and the juncture of the band and dependent side portion. The ¼ inch margin may decrease by approximately 50% while in its operative form and serves to protect the aperture from tearing while in operation.

The band of the protector may comprise a substantially elastic fabric of nylon, lycra, terry, plush or VELCRO TM laminated on one or both sides to a neoprene core, which is water-resistant and affords warmth to the wearer. It may be of different colors to match the wearer's wet suit, swimsuit or other outerwear. The elastic property of the material allows the aperture to expand to conform around the outer edge of the watch crystal or encircling bezel, and contracts to be sufficiently taut to prevent the underlying wrist watch from rotating around on the wearer's wrist, and the edges to curl around the band.

The elastic property of the material permits a one size fits all construction so the wearers may use the same band for all sports watches and wrist sizes. The material comes in a variety of stretch properties, usually with the percentage stretch being greater along one axis of the fabric than the axis perpendicular thereto (differential stretch). The best mode of the invention entails orienting the length of the protector band, i.e. the circumference, along the axis of maximum stretch for the material. In such a manner, the band has maximum stretch for sizing and will enable it to fit more wearers. Also, the differential stretch, properly oriented, helps fit square or rectangular openings and causes the edges to curl around the watch band and bezel for a secure fit.

The central aperture of the invention allows the wearer to access the watch crystal, encircling bezel and dials and buttons attached thereon for purposes of adjusting settings. The aperture consists of a substantially oval or rectangular shape in its relaxed form, and expands to conform to the size and shape of the wearer's wrist watch.

The measurements of the sports wrist watch protector of the invention are an important feature of the invention. The width of the dependent side portions are approximately 3/16 inch, the width of the band, measured at the section opposing the central aperture, is approximately 1 to 1⅛ inches. At the extended portion of the band in the region of the aperture, the band width measurement increases to approximately 1½ inches to accommodate an aperture of approximate size of 1 inch, leaving a ¼ inch margin on each side of the aperture. The width of the aperture is approximately ½ inch in its relaxed form, and may stretch to any size up to 200 percent initial size.

DRAWINGS

DETAILED DESCRIPTION OF THE BEST MODE

The following detailed description illustrates the invention by way of example and not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

Figure 1:
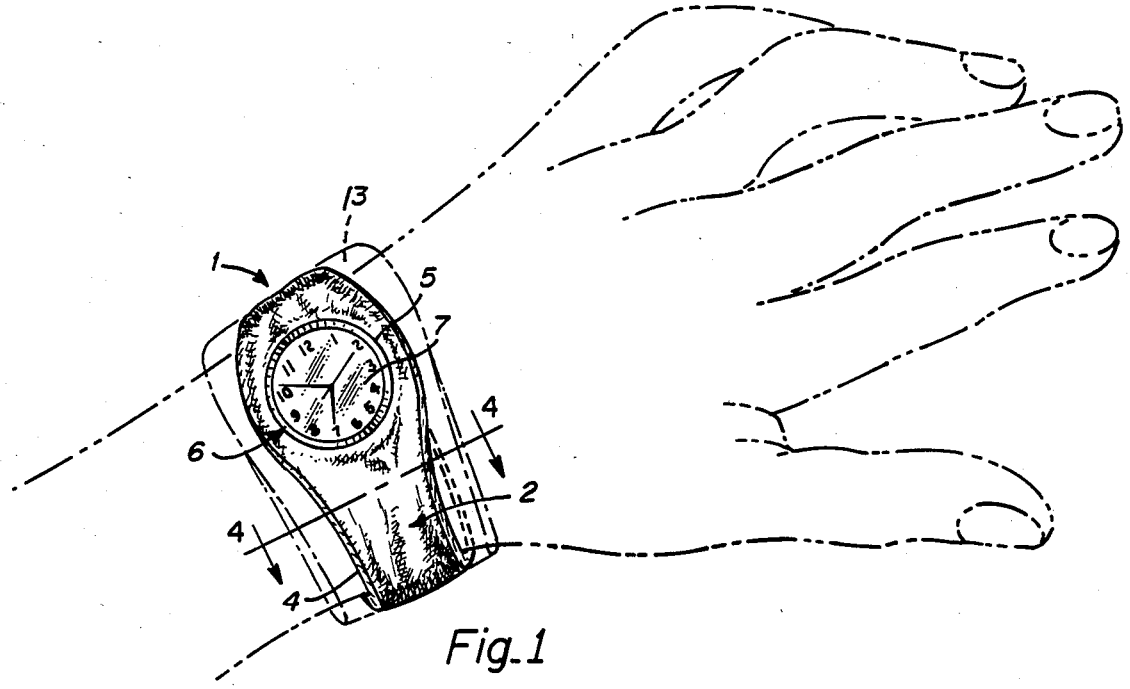
FIG. 1 is a three-quarters perspective view of the sports wrist watch protector band of this invention in its operative form on the wrist of a wearer.

FIG. 1 shows the sports wrist watch protector 1 of the invention in three-quarters perspective in its operative form on the wrist of the wearer. The protector comprises a continuous main band 2 with a central aperture 5 and dependent side portions 4. The central aperture accommodates and completely encircles the sports wrist watch bezel 6 which is integral with the watch crystal 7. Note that the watch bezel 6 and watch crystal 7 are exposed, thus enabling the wearer to make adjustments to the watch as required with most sports watches. A wearer of a sports watch may be using the stop-watch function, the depth/time function or any of the various other applications attributed to sports watches. If the watch crystal 7 is covered, or the watch bezel 6 inaccessible to the wearer, the sports watch could not function in the manner for which it was designed.

Figure 2:
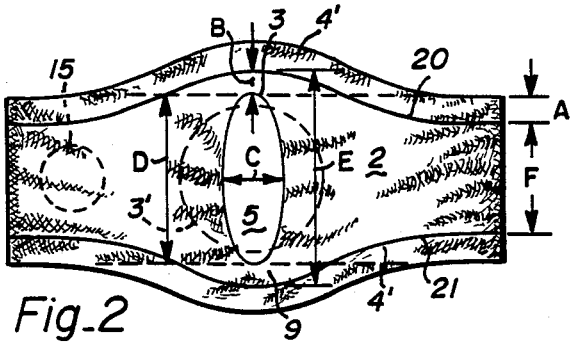
FIG. 2 is a top elevation view of the protector band of this invention showing the central aperture for a round bezel in its relaxed position, and showing in dashed lines the operative flexed position.
Figure 3:
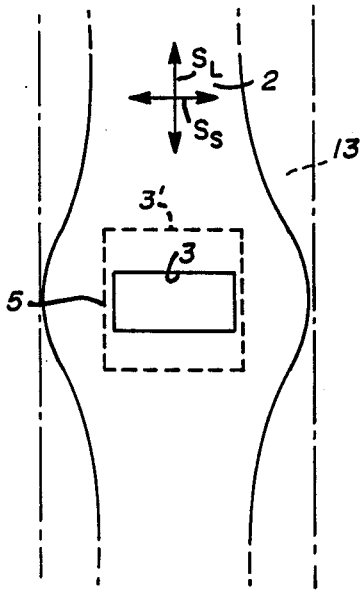
FIG. 3 is a top elevation view of the protector in its alternate form, showing the central aperture for a square or rectangular watch in its relaxed position, and showing in dashed lines the operative flexed position.

FIGS. 2 and 3 show the important differential stretching feature. As best shown in FIG. 2 for a round dial watch, the central aperture 5 has two positions, a relaxed mode 3 and a flexed mode 3, (shown in dashed lines). The shape of the central aperture in relaxed mode 3 is substantially oval with its major axis transverse to the band axis, i.e. parallel to the long axis of the wearer's arm. The band axis (circumference) corresponds to the direction of greatest percentage stretch of the material. This orientation allows for a wide range in sizing, and a tighter fit at the aperture.

The section of the band in which the central aperture 5 is located is broadened to furnish a surrounding margin of material 9, of width B, sufficient to prevent tearing of the material upon use. Measurement B is approximately ¼ inch in its relaxed form, and may diminish as much as 50 percent in width in its operative stretched position (FIG. 1). The band width, as measured at F, is approximately to 1⅛ inches, and is broadened to approximately 1½ inches, as measured at E, around the central aperture.

As shown in FIG. 2 the central aperture 5 is initially oval in the relaxed mode 3, which, due to differential stretching, is transformed substantially to a circle upon stretching in use (FIG. 1, and dashed lines 3, in FIG. 2).

FIG. 3 shows this transformation for a square or rectangular faced watch. Initially the relaxed mode aperture 3 is rectangular with the longer axis oriented transverse to the band axis. Upon stretching to the use mode 3, the aperture is converted to a square as shown in FIG. 3. The aperture could be stretched further to a rectangle, with the long axis parallel the band if need be.

The central aperture 5 is specially cut to form a tight fit around the watch bezel or watch crystal when operatively placed, thus aiding in securing the watch to the wearer's wrist. In FIG. 2, distance C, the minor axis of the relaxed mode central aperture oval 3, is approximately ½ inch. Distance D, the major axis of the central aperture is approximately 1 inch. If the opening is too big, the watch will slip fully around the wearer's wrist, and the pins from the band would fall through the aperture. Additionally, if the watch crystal and bezel are not secure, it would be difficult for the wearer to access them for use while participating in a sports activity. On the other hand, if the opening is too small, the watch bezel would be inaccessible to the wearer at all times.

Figure 4:
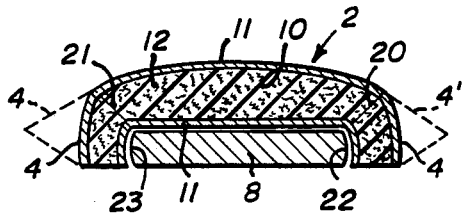
FIG. 4 is an enlarged cross-sectional view of the band of this invention showing the curled marginal edges in operative position and showing in dashed lines the marginal edges in relaxed position.

As best seen in FIG. 4, which shows a cross-section of the watch band taken along line 4—4 of FIG. 1, the band 2 is a fabric laminate with a central portion 12 comprising closed-cell elastomeric material 10, with differentially bi-directional stretch nylon 11 laminated on both sides. I prefer use of double-nylon backed neoprene laminate of thickness in the range of 1/16" to ⅜", preferably ¼". The neoprene elastomer preferably has a tensile strength of approximately 80–100 psi and elongation at breaking point ranging from 325–600 percent. Where the materials have differential surface stretch (length vs width) the preferred orientation of the band 2 is to position it such that the axis of the greater percentage stretch is along the length (circumference) of the band. This permits more stretch for sizing purposes and provides the critical oval-to-round and rectangular-to-square, relaxed-to-stretched opening change modes.

The material may have different colors on each side, making the protector reversible. This is particularly useful for when the protector gets dirty or when the wearer wishes to match changing styles. The color may be fluorescent, or fabric coated with reflective beads, to facilitate visibility of the wearer, thus incorporating a safety feature into the invention. Likewise, a microwave transponder 15 (FIG. 2) may be incorporated in the band.

The band 2 completely covers the wearer's watch band 7, with the dependent side portions 4 angled downward from position C to position D to enclose the watch band. The dependent side portions 4 may be either integral with the band 2 (FIGS. 1 and 3), or sewn or glued thereto along lines 20, 21 as shown in FIGS. 2 and 4. When using the bi-directional differential stretch elastomeric laminate material, upon stretching, the side margins 4', 4' in FIG. 2 curl around the edges 22, 23 of the watch band to the position 4, 4 shown in FIG. 4. This can be enhanced, if desired, by making the side margins 4, 4 separately, with the stretch orientation at 90° to the stretch orientation of the central band portion 2. The band material is substantially elastic, thus requiring only one size of manufacture. The elastic material and the specific shape of the central aperture allows the user to use the same protector for different wrist watches.

It should also be understood that the band need not have an enlarged watch face portion. For example, as shown in phantom lines in FIGS. 1 and 2 the band 13 may be substantially straight band of width twice to three times the width of the watch band.

It should be understood that various modifications within the scope of this invention can be made by one of ordinary skill in the art without departing from the spirit thereof. For example, a microwave transponder 15 (FIG. 2) may be incorporated in the band (sewn, glued, or inserted in a pocket formed in the band) as a safety feature to assist in locating the wearer when lost. A lost skier or hiker wearing the transponder band of this invention can be located, even at night or beneath snow or water, by helicopter beaming microwaves to the ground. The transponder's reflective signal picked up by the receiving equipment on the helicopter serves to pinpoint the wearer. This is particularly helpful for locating lost children wearing a watch band of this invention. I therefore wish my invention to be defined by the scope of the appended claims as broadly as the prior art will permit, and in view of the specification if need be.

I claim:

1. A protector band for a sports wrist watch having a crystal, a surrounding bezel and a watch band, comprising in operative combination:

(a) a continuous uniform band of elastomeric material having fabric material laminated to both sides thereof, said continuous band having a diameter, in a relaxed state thereof, less than the diameter of a normal human wrist;

(b) said continuous band having a main band portion, side margins, and a watch face viewing portion having a central aperture through which said watch crystal and said bezel are accessible;

(c) portions of said band adjacent to said marginal edges being adapted when stretched to curl around the sides of said watch band; and (d) said aperture having a major axis longer than a minor axis at ninety degrees thereto, said major axis being oriented transverse to the circumferential length of the protector band so that said aperture stretches along the minor axis more than along the major axis.

2. A protector band as is in claim 1 wherein said aperture is oval when relaxed, and is adapted when stretched to fit watches having round crystals and oval crystals, said oval crystals being oriented with its long axis transverse to the long axis of said aperture oval.

3. A protector band as in claim 1 wherein said aperture is rectangular when relaxed, and is adapted when stretched to fit watches having square crystals and rectangular crystals, said rectangular crystals being oriented with its long axis transverse to the long axis of said aperture rectangle.

4. A protector band as in claim 1 wherein said band material is a nylon-faced neoprene laminate.

5. A protector band as in claim 4 wherein said laminate has a thickness in the range of from about 1/16" to about ⅜", a tensile strength of in the range of from about 80 to about 100 psi, and elongation at breaking point in the range of from about 325 to about 600 percent.

6. A protector band as in claim 4 wherein said fabric on one side is of a color different than the other side.

7. A protector band as in claim 1 wherein at least one said fabric materials has safety treatments selected from bright colors and reflective coatings.

8. A protector band as in claim 1 wherein said elastomeric laminate has differential stretch.

9. A protector band as in claim 8 wherein the long axis of stretch is oriented parallel to the circumference of said band.

10. A protector band as in claim 2 wherein:

(a) said band material is a nylon-faced neoprene laminate; and (b) said laminate has a thickness in the range of from about 1/16" to about ⅜", a tensile strength of in the range of from about 80 to about 100 psi, and elongation at breaking point in the range of from about 325 to about 600 percent.

11. A protector band as is in claim 10 wherein:

(a) said fabric on one side is of a color different than the other side;

(b) said elastomeric laminate has differential stretch; and (c) the long axis of stretch is oriented parallel to the circumference of said band.

12. A protector band as in claim 3 wherein:

(a) said band material is a nylon-faced neoprene laminate;

(b) said laminate has a thickness in the range of from about 1/16" to about ⅜", a tensile strength of in the range of from about 80 to about 100 psi, and elongation at breaking point in the range of from about 325 to about 600 percent;

(c) said fabric on one side is of a color different than the other side;

(d) said elastomeric laminate has differential stretch; and (e) the long axis of stretch is oriented parallel to the circumference of said band.

13. A protector band as in claim 11 wherein at least one said fabric materials has safety treatments selected from bright colors and reflective coatings.

14. A protector band as in claim 12 wherein at least one said fabric materials has safety treatments selected from bright colors and reflective coatings.

15. A protector band as in claim 1 wherein said elastomeric material has differential stretch with the longer stretch direction being oriented parallel to the circumference of said band and transverse to the axis of the wearer's wrist.

* * * * *